United States Patent [19]

Vickers et al.

[11] 4,422,884

[45] Dec. 27, 1983

[54] METHOD OF TREATING A CONTINUOUSLY CAST STRAND FORMED OF STAINLESS STEEL

[75] Inventors: David P. Vickers; Kenneth Mayland, both of Sheffield; Gordon K. Allan, Rotherham, all of England

[73] Assignee: Concast AG, Zurich, Switzerland

[21] Appl. No.: 951,997

[22] Filed: Oct. 16, 1978

[30] Foreign Application Priority Data

Oct. 20, 1977 [GB] United Kingdom ..... 43724/77

[51] Int. Cl.[3] ..... C21D 8/00

[52] U.S. Cl. ..... 148/2; 148/12 E

[58] Field of Search ..... 148/2, 12 E, 12 EA, 148/12 B, 135, 136, 37, 38, 39, 12 R; 164/417; 266/103; 29/527.6, 527.7, 526.3

[56] References Cited

U.S. PATENT DOCUMENTS

| | | | |
|---|---|---|---|
| 3,247,029 | 4/1966 | Sims | 148/12 E |
| 3,606,785 | 9/1971 | Olsson | 164/417 |
| 3,663,312 | 5/1972 | Kindlimann | 148/12 E |
| 3,678,571 | 7/1972 | Schoffman | 29/527.6 |
| 3,702,268 | 11/1972 | Jakenberg | 148/12 E |
| 3,710,436 | 1/1973 | Schoffman | 29/527.6 |
| 3,732,126 | 5/1973 | Cobb et al. | 148/12 E |
| 3,837,207 | 9/1974 | Tarmann | 29/527.7 |
| 4,204,884 | 5/1980 | Berg et al. | 148/12 R X |

FOREIGN PATENT DOCUMENTS

| | | | |
|---|---|---|---|
| 1062945 | 3/1967 | United Kingdom | 148/12 E |
| 1218930 | 1/1971 | United Kingdom | 148/2 |

*Primary Examiner*—Peter K. Skiff

*Attorney, Agent, or Firm*—Werner W. Kleeman

[57] ABSTRACT

A method of treating a continuously cast strand formed of stainless steel, wherein, prior to cutting the strand, the surface layer of the strand is deformed at oppositely situated sides by oppositely situated rollers of at least one pair of rollers and subsequently heated in order to produce a recrystallized marginal zone of more than three millimeters thickness for each such deformed side of the strand.

11 Claims, No Drawings

METHOD OF TREATING A CONTINUOUSLY CAST STRAND FORMED OF STAINLESS STEEL

BACKGROUND OF THE INVENTION

The present invention relates to a new and improved method of treating a continuously cast strand formed of stainless steel, wherein the strand is withdrawn by rolls, cut and heated for further processing.

Continuously cast strands formed of stainless steel often have oscillation or ripple marks and surface flaws or defects, such as, for instance, slag inclusions. During the subsequent rolling operations, for instance of the slab into a hot band or strip, there occur surface flaws or defects, such as shell or sliver, which appear in the form of small surface cracks or fissures. The problem is particularly acute in the case of hot bands or strip which are fabricated from austenitic stainless steel. An important factor contributing to this problem is the necessity of pronounced grinding of the slab for surface rectification. Due to such surface grinding there is also ground a very thin, fine grained marginal zone or surface layer, which has been formed during the continuous casting process, with the result that there is exposed the coarse columnar structure within. During subsequent heat treatment in a reheating furnace oxygen and sulphur penetration of the product may occur along the grain or columnar boundaries. This ultimately leads to surface break-up or to shell-sliver formation owing to the insufficient hot ductility and to large grinding losses during the treatment of the rolled product.

With non-stainless steels there are known to the art processes in order to eliminate the liquation and/or porosity at the center of a continuously cast strand by thickness reduction at the region of final solidification. Furthermore, there are known processes which deform the strand in the continuous casting installation or immediately following the same in order to reduce the cross-section or for smoothing the strand surface. In this way, starting from an initial cross-section it is possible to directly produce different desired final cross-sections while utilizing the casting heat present within the strand.

OBJECTS OF THE INVENTION

Therefore, it is a primary object of the present invention to improve the surface quality of a continuously cast material, especially to prevent the shell/sliver formation and to reduce the grinding losses.

DETAILED DESCRIPTION OF THE PREFERRED EMBODIMENTS

Now in order to implement these objects and others which will become more readily apparent as the description proceeds, the invention contemplates deforming the surface layer of the strand, prior to cutting, by means of oppositely situated rollers of at least one pair of rollers and subsequently heating the strand, in order to produce a recrystallized marginal or external zone of more than three millimeters thickness at each side of the strand which has been deformed.

Due to the deformation of the already solidified surface layer energy is stored at the region of or near the surface, which, during subsequent heating, is released and causes the formation of a recrystallized marginal or external zone with fine grained structure. The thickness of the recrystallized zone must be greater than that of the ground layer. The latter amounts to about two to three millimeters, so that the recrystallized zone at each side of the strand must amount to more than three millimeters. This fine grained structure provides higher resistance against the penetration of oxygen and sulphur at the grain boundaries and prevents, by virtue of the high hot ductility, formation of slivers or fissures at the surface.

Due to the deformation there is not only prevented the occurrence of surface flaws or defects but rather there also are caused to disappear oscillation marks and depressions, so that the subsequent grinding of the cut slab can be merely quite superficial. Consequently, there is obtained, on the one hand, an increase of the yield in the order of about one percent and, on the other hand, due to the smaller grinding depth there is less danger of removing the deformed surface layer.

The subsequent heating to about 1220° C. to 1260° C., for further processing at the rolling mill, produces a recrystallized zone having a thickness of about fifteen millimeters. Due to the improved surface there is realized, during the further processing, a saving in time and a further increase of the yield due to less grinding losses at the produced band or strip.

The invention can be employed with continuous casting installations having straight or curved guide paths. The deformation of the strand surface layer can be accomplished in a number of stages. Advantageously, the strand is deformed by oppositely situated rollers or rolls of a withdrawal and/or straightening unit.

It is important that the deformation of the surface layer be accomplished in such a way that during the recrystallization brought about by the subsequent heating, there is formed a fine grained zone which is thicker than the layer at the cut strand which is to be ground away. In this regard it is also of advantage that the strand be completely solidified prior to passage through the deformation region of the roller track, since otherwise there exists the possibility that only the liquid core will be compressed together.

The deformation occurs advantageously at an average surface temperature in the order of 650° C. to 1100° C.

In order to obtain the desired thickness of the recrystallized marginal or external zone the deformation, i.e., the thickness reduction, should amount to five to ten millimeters.

Prior to deformation the strand can advantageously pass a temperature equalisation or compensation zone, or the edges of the strand additionally can be heated in order to obtain a uniform temperature distribution, and thus, more uniform deformation and preventation of fissure formation.

The invention now will be described more fully in conjunction with an example. It is thought unnecessary to illustrate the continuous casting installation since the same is composed of well known components and the details thereof are unnecessary for understanding the method of the invention. In such a conventional continuous casting installation there is cast a slab having a thickness of 150 millimeters from austenitic stainless steel. The installation possesses a continuous casting mold having a curved hollow mold compartment, a subsequent secondary cooling zone and a withdrawal-straightening unit, all as known in the art of continuous casting. The secondary cooling zone is subdivided into four successive, independently regulatable cooling zones. The straightening or straightener unit consists of five segments or housings each having three oppositely situated rolls. Upon entry of the strand into the first pair of rolls of the straightening unit the strand has completely solidified. The temperature of the slab at the center, upon entry at the straightening unit, amounts to about 1450° C., upon exit to about 1200° C. The surface temperature of the slab at the center or mid-face and at the edges or corners, upon entry and exit, amounts to approximately 1000° C. and 750° C., respectively. The desired setting of such temperatures can be accomplished by regulating the quantity of coolant or cooling water at the individual cooling zones. The roller pairs of the straightening unit are adjusted such that during each passage of the strand through a roller pair there is accomplished a thickness reduction by about 0.5 millimeters. This produces in toto, at the fifteen passes, a reduction of 7.5 millimeters. Due to the deformation there is caused both a storage of deformation energy near to the slab surface and also there are largely eliminated the oscillation marks.

After the straightening unit the strand is cut and heated in a furnace for about two hours at 1220° C. Then, at the deformed surface layer there is produced, by release of the deformation energy, a recrystallized marginal or external zone of about thirty millimeters to both sides of the slab and possessing a fine granular structure. The continuously cast slab is then rolled into a hot band or strip. The inspection of the hot band shows that there is present an extremely good surface without any slivers or fissures, so that grinding of the band was not or hardly necessary.

While there have been described present preferred embodiments of the invention, it is to be distinctly understood that the invention is not limited thereto, but may be otherwise variously embodied and practiced within the scope of the following claims. Accordingly,

What we claim is:

1. A method of treating a continuously cast strand formed of stainless steel, comprising the steps of:

casting a continuously cast strand of stainless steel;

passing the cast strand through oppositely situated rollers of a plurality of opposed rollers;

deforming the surface layer of oppositely situated sides of the strand prior to cutting of the strand by means of the oppositely situated rollers of said plurality of opposed rollers, in order to store energy in the surface layer of said oppositely situated sides of the strand and to concentrate the deformation at the strand surface;

subsequently heating the strand; and thus producing by the deformation and subsequent heating a recrystallized marginal zone of more than three millimeters thickness at each of the oppositely situated deformed sides of the case strand.

2. The method as defined in claim 1, further including the steps of:

accomplishing deformation over a number of stages.

3. The method as defined in claim 1, further including the steps of:

deforming the strand by oppositely situated rollers of a withdrawal unit.

4. The method as defined in claim 1, further including the steps of:

deforming the strand by oppositely situated rollers of a straightening unit.

5. The method as defined in claim 1, further including the steps of:

deforming the strand by oppositely situated rollers of a withdrawal and straightening unit.

6. The method as defined in claim 1, further including the steps of:

completely solidifying the strand prior to the deformation.

7. The method as defined in claim 1, further including the steps of:

deforming the strand at an average surface temperature in the order of about 650° C. to 1100° C.

8. The method as defined in claim 1, wherein:

the deformation amounts to about five to ten millimeters in the direction of the strand thickness.

9. The method as defined in claim 1, further including the steps of:

passing the strand through a temperature equalisation zone prior to deformation.

10. The method as defined in claim 1, further including the steps of:

additionally heating the edges of the strand prior to the deformation.

11. The method as defined in claim 1, further including the steps of:

releasing the stored energy during the subsequent heating of the strand in order to form a recrystallized marginal layer at the strand.

* * * * *